US006082546A

United States Patent [19]

Liao et al.

[11] Patent Number: 6,082,546

[45] Date of Patent: Jul. 4, 2000

[54] SHOCK-RESISTANT CONTAINER

[75] Inventors: Chung-Chi Liao, Taoyuan; Ming-Hsueh Tsai, Taipei; Tai-Ling Chan, Taoyuan, all of Taiwan

[73] Assignee: Acer Peripherals, Inc., Taiwan

[21] Appl. No.: 09/209,422

[22] Filed: Dec. 11, 1998

[30] Foreign Application Priority Data

Jan. 13, 1998 [TW] Taiwan ..... 87200534

[51] Int. Cl.[7] ..... B65D 81/02

[52] U.S. Cl. ..... 206/592; 206/320

[58] Field of Search ..... 206/521, 586–588, 206/591, 592, 594, 524.1, 320, 576

[56] References Cited

U.S. PATENT DOCUMENTS

| | | | |
|---|---|---|---|
| 2,808,189 | 10/1957 | Williams | 206/592 |
| 2,808,595 | 10/1957 | Emery | 206/592 |
| 3,016,177 | 1/1962 | Chaplin | 206/521 |
| 3,266,705 | 8/1966 | Wood | 206/594 |
| 3,752,384 | 8/1973 | Siburn | 206/521 |
| 5,156,277 | 10/1992 | Witz | 206/592 |
| 5,806,683 | 9/1998 | Gale | 206/592 |

*Primary Examiner*—Paul T. Sewell
*Assistant Examiner*—Luan K. Bui
*Attorney, Agent, or Firm*—Pillsbury Madison & Sutro LLP

[57] ABSTRACT

The present invention provides a container for a product, which comprises: a bottom portion; side walls connected to edges of the bottom portion; at least one first supporting portion protruding from the bottom portion of the container. The first supporting portion includes at least one convex surface to support the product, at least one concave surface, and a side surface, and both the convex surface and the concave surface are connected to the side surface. When the product is received within the container, the convex surface can support the product, and the product is spaced apart from the concave surface; thus, the cushioning effect of the container is greatly improved.

6 Claims, 6 Drawing Sheets

SHOCK-RESISTANT CONTAINER

BACKGROUND OF THE INVENTION

1. Field of the Invention

This invention relates to a container for products, such as CD-ROM players, susceptible to shock. More particularly, it relates to a container with good shock absorption ability and made of pulp.

2. Description of Prior Art

Conventional packages are made of foamed material. Although their cushioning and protection ability are good, they use too much material and can not be recycled. Therefore, the cost of conventional packaging is high and is detrimental to the environment.

Recently, some people have produced packages from pulp. However, a conventional package made of pulp can not generate enough shock absorption ability. When subjected to an external force, such conventional pulp packages can not withstand the shock generated, thus cracking will inevitably occur. Also, such conventional pulp packages can not fully protect the products during transportation.

As shown in FIGS. 1A–1B, a shock-resistant package that is made of thermoformable plastic is disclosed by U.S. Pat. No. 5,156,277. In this package, all of the side walls are provided with an inwardly molded-in supporting profile to support the product received in the package. In this manner, the product can be protected by the cushioning effect of such profiles. However, some disadvantages still remain such as:

(1) As shown in FIG. 1A, in the bottom supporting profile 6*a,* the concave portion is surrounded by the convex portion. Therefore, when the supporting profile 6*a* is deformed by a downward external force, the concave portion will be depressed downwardly together with the convex portion. Thus, no gradual deformation results, and a cushioning effect resulted from gradual deformation can not be attained.

(2) As shown in FIG. 1A, the heights of the four supporting profiles 2*a,* 3*a,* 4*a,* 5*a* are limited to avoid the interference between them after the package has been assembled. Therefore, the shock absorption ability of the four supporting profiles 2*a,* 3*a,* 4*a,* 5*a* are limited due to insufficient height.

(3) As shown in FIG. 1B, the shape of the supporting profile is adapted to the contours of the product; therefore, the concave portion and the convex portion of the supporting profile fully contact the product. When the supporting profile is subjected to an external force, both the concave portion and the convex portion will be deformed simultaneously, thus, no gradual deformation results, and the cushioning effect of the supporting profile is not sufficient.

As a result, the above-mentioned conventional package is not suitable for use in protecting electronic devices such as CD-ROM players due to an insufficient cushioning effect.

SUMMARY OF THE INVENTION

The object of the invention is to solve the above-mentioned problems and to provide a shock-resistant container with good cushioning effect.

To achieve the above object, according to the first feature of the present invention, the container for a product of the present invention comprises:

a bottom portion;

side walls connected to edges of the bottom portion; at least one first supporting portion protruding from the bottom portion of the container, the first supporting portion including at least one convex surface to support the product, at least one concave surface, and a side surface, both the convex surface and the concave surface being connected to the side surface, whereby when the product is received within the container, the convex surface can support the product, and the product is spaced apart from the concave surface.

According to the second feature of the present invention, the container for a plurality of products of the present invention comprises:

a bottom portion;

side walls connected to edges of the bottom portion;

a plurality of separating portions protruding from the bottom of the container to separate the container into a plurality of receiving portions; and a plurality of fourth supporting portions, each of which is formed in each receiving portions and is protruded from the bottom of the container to support each product received within the receiving portion.

BRIEF DESCRIPTION OF THE DRAWINGS

The present invention can be more fully understood by reading the subsequent detailed description and examples with reference made to accompanying drawings, wherein.

DETAILED DESCRIPTION OF THE PREFERRED EMBODIMENT

First Embodiment

Figure 1A:
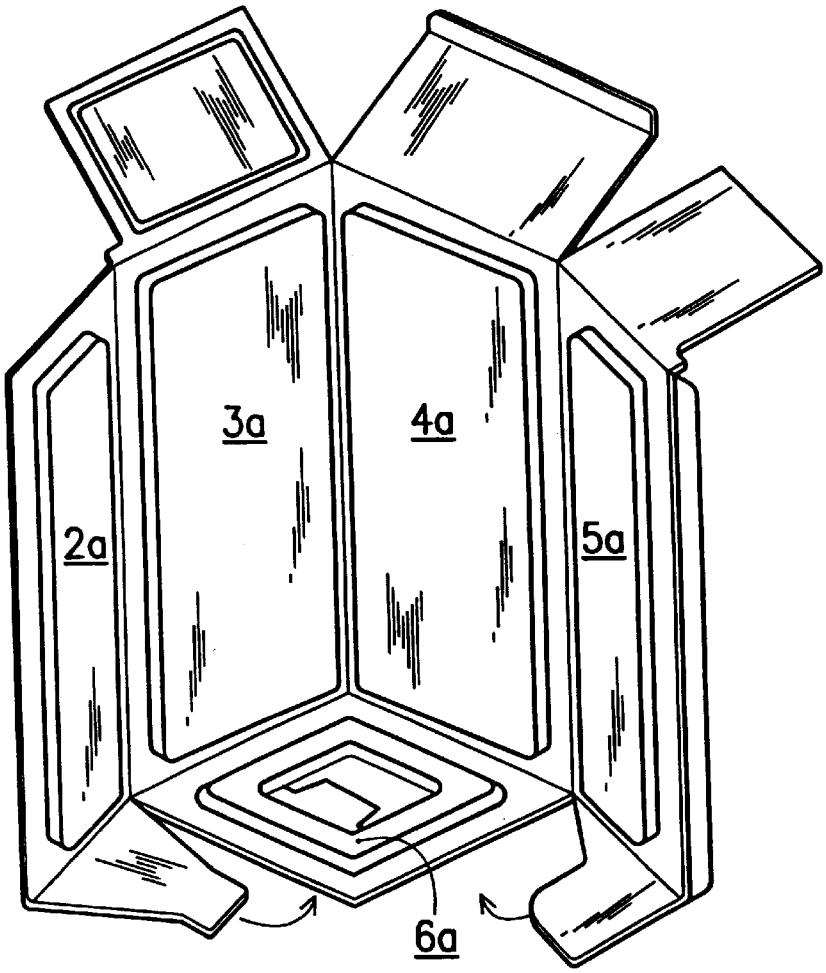
FIG. 1A (PRIOR ART)
FIGS. 1A–1B shows the package according to U.S. Pat. No. 5,156,277.
Figure 1B:
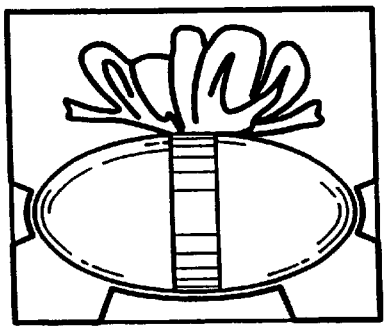
FIG. 1B (PRIOR ART)
Figure 2:
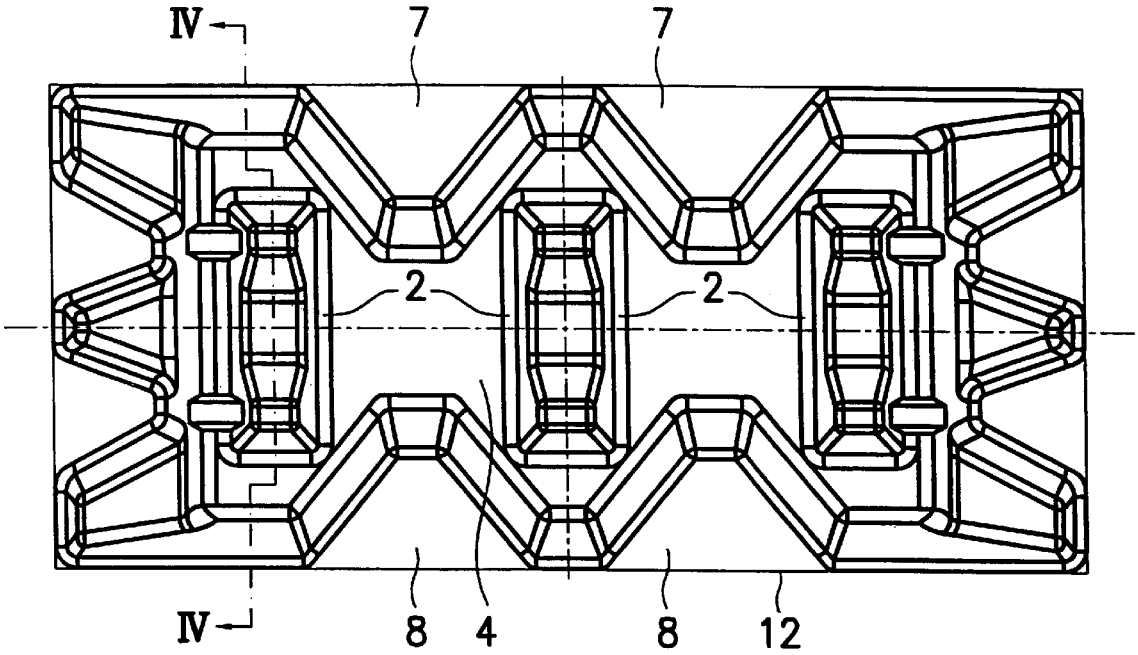
FIG. 2 is a top view of the container according to the first embodiment of the present invention.
Figure 3:
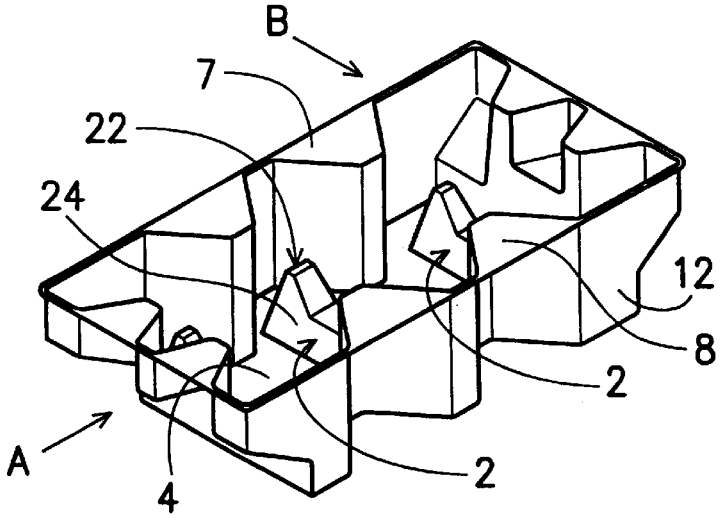
FIG. 3 is a perspective view of the container according to the first embodiment of the present invention.
Figure 4:
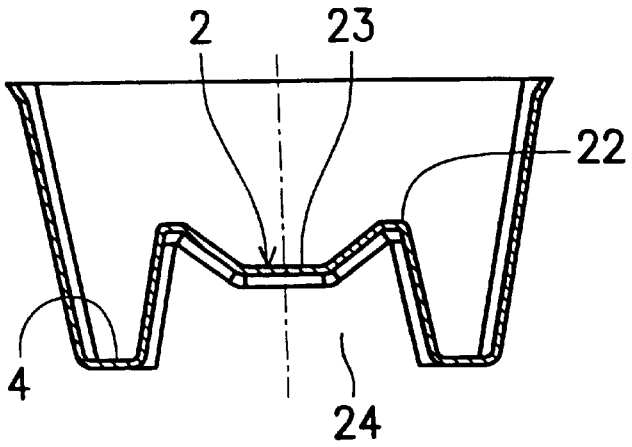
FIG. 4 is a cross-sectional view taken along the line IV—IV in FIG. 2.

FIG. 2 is a top view of the container according to the first embodiment of the present invention, and FIG. 3 is a perspective view of the container. FIG. 4 is a cross-sectional view taken along the line IV—IV in FIG. 2. Referring to FIGS. 2–4, a container includes a bottom portion 4, side walls 12 connected to edges of the bottom portion, and a plurality of first supporting portions 2. Optionally, a plurality of second supporting portions 7 and a plurality of third supporting portions 8 are provided.

The first supporting portion 2 is protruded from the bottom portion 4 of the container. The second supporting portion 7 is protruded from the side walls 12 of the container. The third supporting portion 8 is also protruded from the side walls 12 of the container, and each third supporting portion 8 is opposite to each second supporting portion 7.

The first supporting portion 2 includes at least one convex surface 22, at least one concave surface 23, and a side surface 24. Both the convex surface 22 and the concave surface 23 are connected to the side surface 24. In the figures, the first supporting portion 2 includes two convex surfaces 22 and one concave surface 23, in which the convex surfaces 22 are separated by the concave surface 23.

Figure 5:
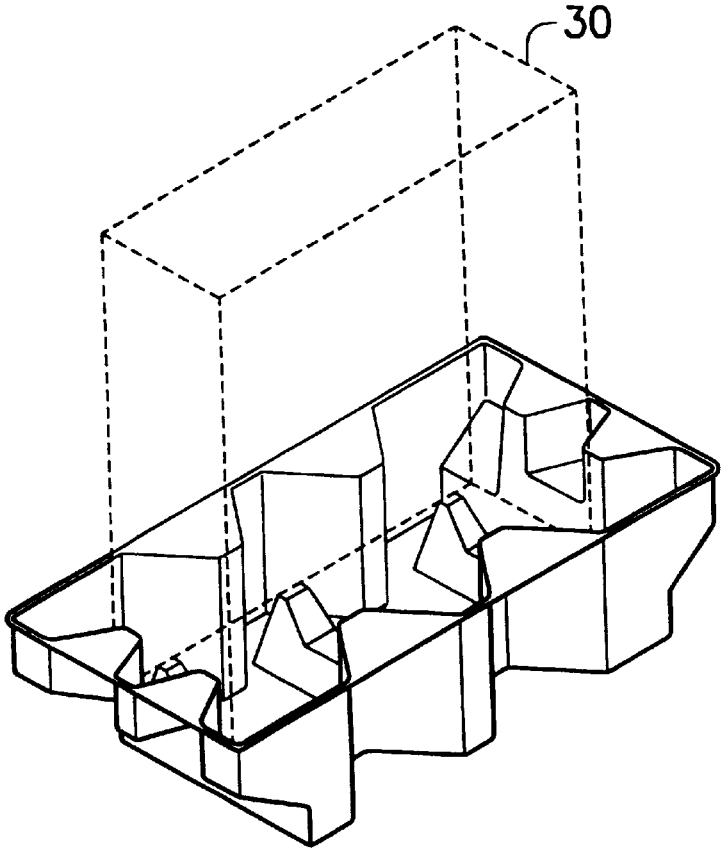
FIG. 5 is a perspective view of the container according to the first embodiment of the present invention, wherein a CD-ROM player is received in the container.

The most important feature of the present invention is the design of the first supporting portion 2. Referring to FIG. 5, since the first supporting portion 2 has both convex and concave surfaces, when a product 30 is received within the container, the convex surface 22 can support the product, and the product is spaced apart from the concave surface 23. In addition, since both the convex and concave surfaces are connected to the side surface, when the convex surface 22 of the first supporting portion 2 is deformed toward the bottom portion 4 of the container, the concave surface 23 will not be depressed and can support the product 30 received within the container. Thus, the deformation of the first supporting portion 2 is in a gradual manner, and an improved cushioning effect can be achieved.

Specifically, when a product received in the container of the present invention suffers from impact by an external force, the bottom portion 4 of the container will first be deformed to offset a first part of the external force. Then, the convex surface 22 will be deformed to offset a second part of the external force. Finally, if the external force is very great, the concave surface 23 will be deformed to offset a third part of the external force. In this manner, the specially designed container of the present invention can protect the product 30 in a multi-stage manner (a gradual deformation manner). Therefore, the cushioning effect of the container is greatly improved, and thus the container is sufficient to protect a CD-ROM player, which is susceptible to shock.

To achieve better cushioning effect, the dimension for each of the first supporting portions 2 is preferably designed such that the total area of the convex surface 22 is less than a half of the area of the first supporting portion 2 connecting the bottom portion 4 of the container.

Figure 6A:
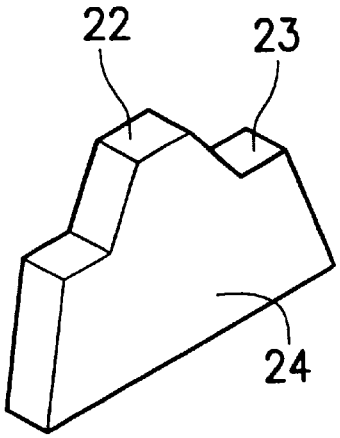
FIGS. 6A–6B are perspective views of other variations of the first supporting portion according to the first embodiment of the present invention.
Figure 6B:
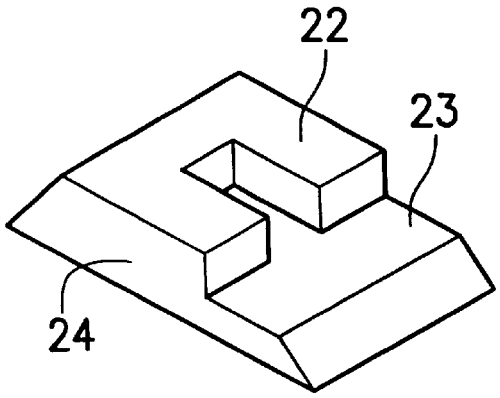

FIGS. 6A–6B are perspective views of other variations of the first supporting portion 2 according to the first embodiment of the present invention. Basically, the shape of the convex surface 22 and concave surface 23 can be in various forms, provided that the concave surface 23 is spaced apart from the product received and that the convex surface 22 and concave surface 23 are both connected to the side surface 24 of the first supporting portion 2.

Figure 7:
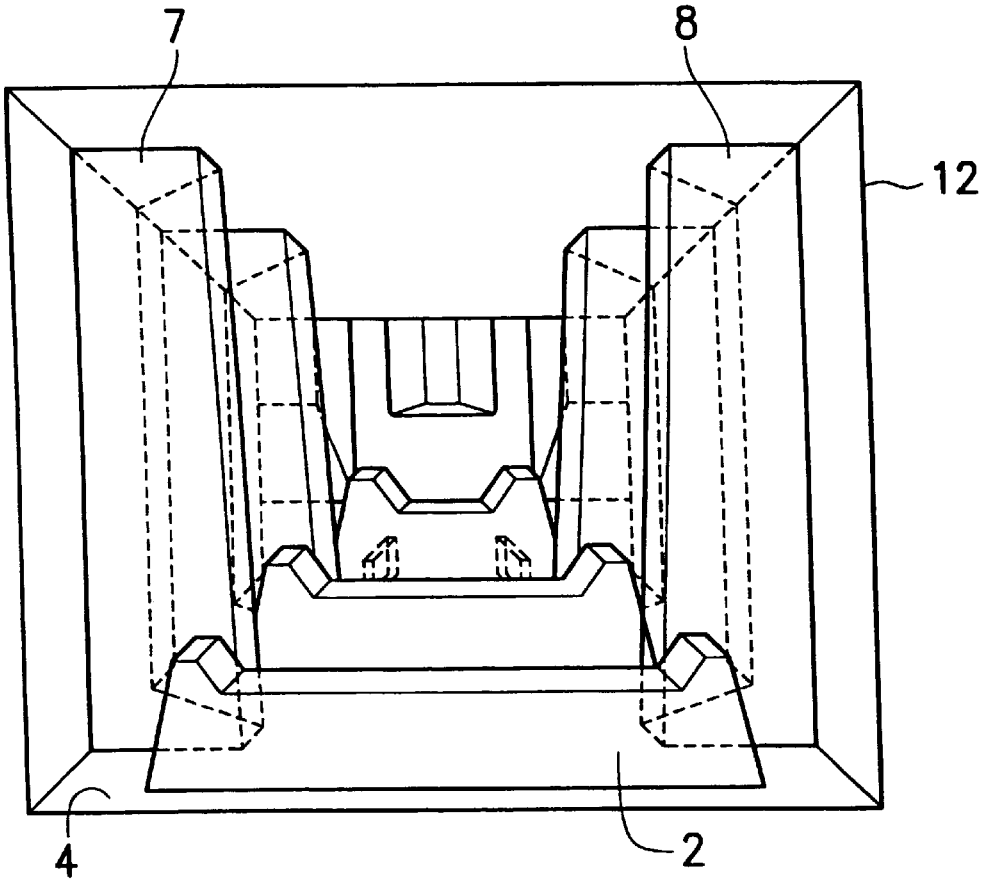
FIG. 7 is a perspective view of the container according to the first embodiment of the present invention, showing the dimensional relationship among the first supporting portions, the second supporting portions, and the third supporting portions.

FIG. 7 is another perspective view of the container according to the first embodiment of the present invention, showing the dimensional relationship among the first supporting portions 2, the second supporting portions 7, and the third supporting portions 8. Referring to FIGS. 2, 3, and 7, the convex and concave surfaces 22 and 23 of the first supporting portion 2 are disposed along a direction parallel to the protruding direction (arrow B) of the second supporting portion 7, such that viewing from the side walls of the container along a direction (arrow A) perpendicular to the protruding direction (arrow B) of the second supporting portion 7, the first supporting portion 2 partially overlaps the second supporting portion 7 and the third supporting portion 8.

In addition, the first supporting portion 2 and the second supporting portion 7 are staggered along the direction (arrow A) perpendicular to the protruding direction (arrow B) of the second supporting portion 7. In this manner, since the height of the first supporting portion 2 is not limited, the cushioning effect of the first supporting portion can be further improved by increasing its height.

If the second and third supporting portions 7 and 8 are provided, when the product 30 is received within the container, the convex portions 22 of the first supporting portions 2, the second supporting portions 7, and the third supporting portions 8 can support the product, and the product is spaced apart from the concave surfaces 23 of the first supporting portions 2.

The container of the present invention can be made of pulp, which is produced from recycled paper material. The bottom portion 4, the side walls 12, the first supporting portions 2, the second supporting portions 7, and the third supporting portions 8 can be integrally formed. The container of the present invention is most suitable for receiving a CD-ROM player.

Second Embodiment

Figure 8:
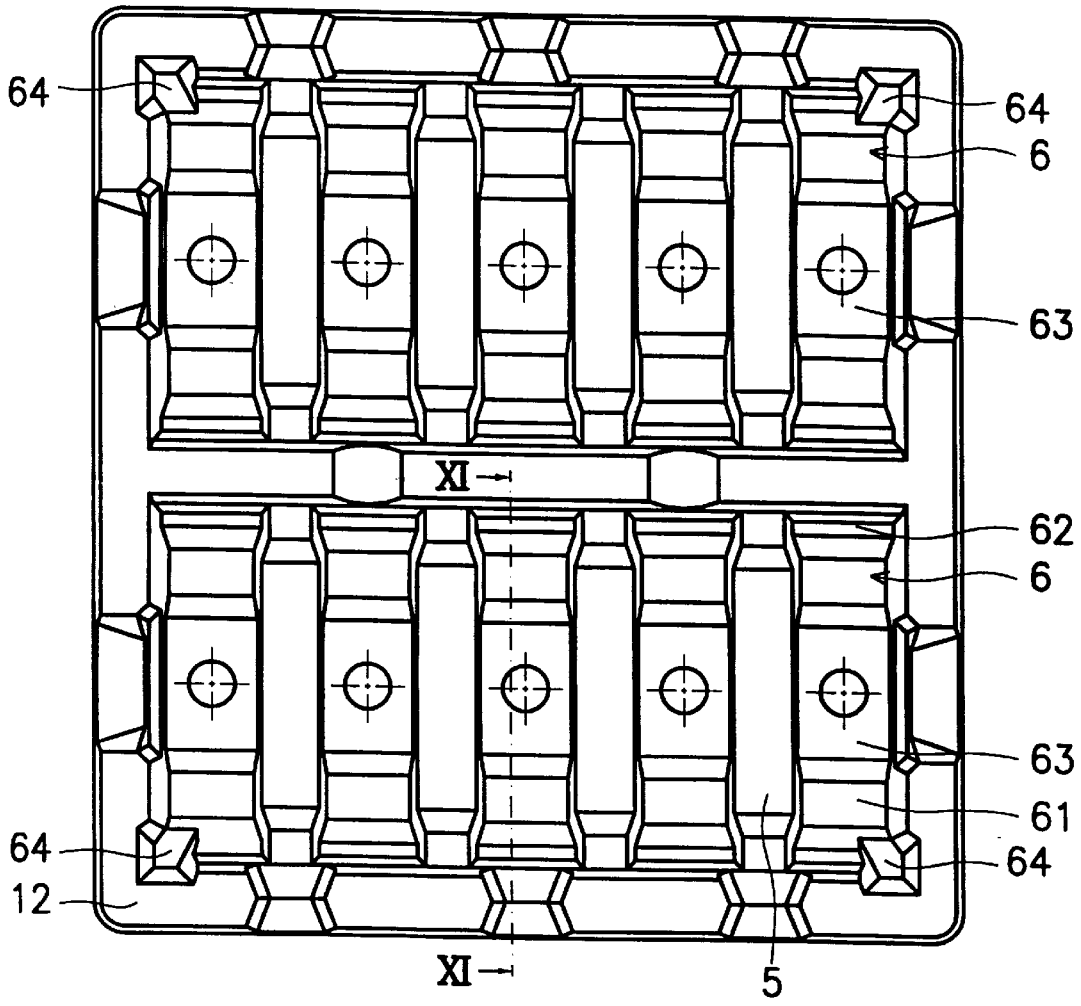
FIG. 8 is a top view of the container according to the second embodiment of the present invention.
Figure 9:
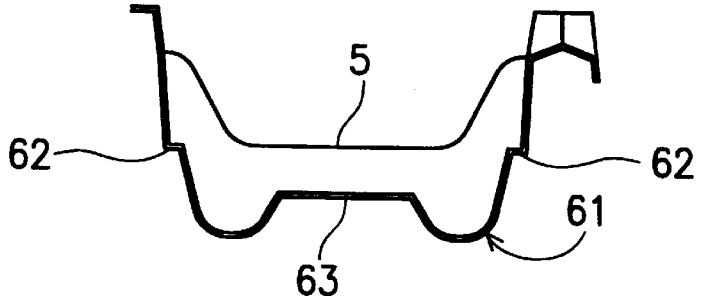
FIG. 9 is a cross-sectional view taken along the line IX—IX in FIG. 8.
Figure 10:
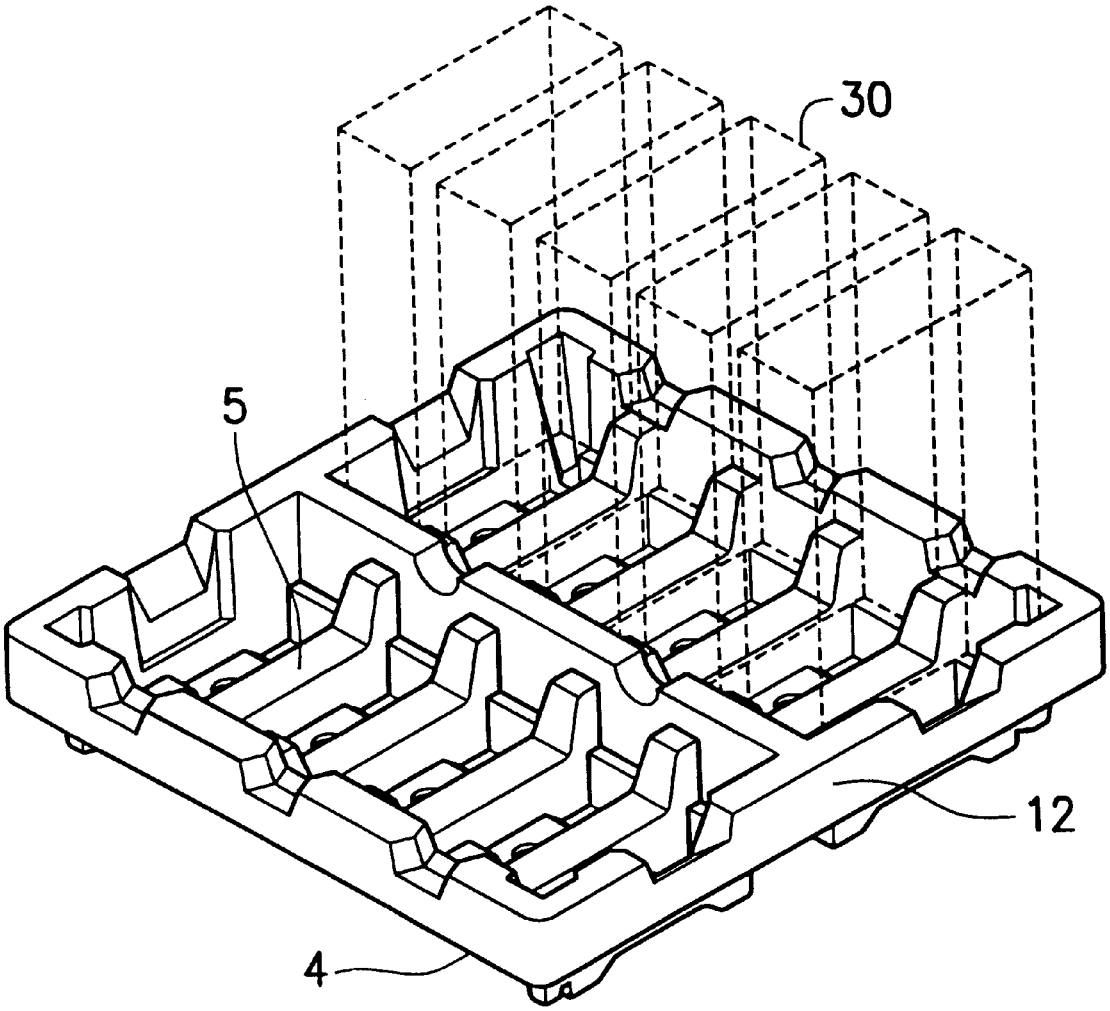
FIG. 10 is a perspective view of the container according to the second embodiment of the present invention, wherein a plurality of CD-ROM players are received in the container.

Referring to FIGS. 8–10, FIG. 8 is a top view of the container according to the second embodiment of the present invention, and FIG. 9 is a cross-sectional view taken along the line IX—IX in FIG. 8, and FIG. 10 is a perspective view of the container according to the second embodiment of the present invention. As shown in the figures, the container includes a plurality of receiving portions 6. Each of the receiving portion 6 consists of a bottom portion 4, side walls 12 connected to edges of the bottom portion 4, a plurality of separating portions 5, a plurality of fourth supporting portions 62, a plurality of fourth concave portions 61, a plurality of cushion flats 63 and four buffer regions 64.

Each of the fourth supporting portions 62 is formed in each receiving portion 6 and is protruded from the bottom portion 4 of the container to support each product received within the receiving portion 6. Preferably, the fourth supporting portion 62 is connected directly to the separating portion 5. Also, each of the fourth concave portions 61 and the cushion flats 63 is formed in each receiving portion 6.

The container of the second embodiment can receive a plurality of products, in which each product is received within each receiving portion 6 separated by the separating portion 5. Then each of products can be supported by the separating portions 5 and confined by the fourth supporting portions 62 and side walls 12.

When the fourth concave portions 61 are deformed upwardly by an external force, the cushion flats 63 will not be depressed immediately. When the external force is very great, then the cushion flats 63 will be depressed and deformed. Thus, a cushioning effect resulting from gradual deformation can be achieved.

Furthermore, each of the buffer regions 64 is formed at corners of the bottom portion 4 so as to absorb the shock when the external force is applied to the corners of the container.

In conclusion, according to the present invention, in the first supporting portion of the container, both the convex and concave surfaces are connected to the side surface. When the convex surface is deformed downwardly by an external force, the concave surface will not be depressed immediately. When the external force is very great, then the concave surface will be depressed and deformed. Thus, a cushioning effect resulting from gradual deformation can be achieved.

In addition, since the height of the first supporting portion is not limited, the cushioning effect of the first supporting portion can be further improved by increasing its height.

Although this invention has been described with a preferred embodiment, it is understood that the scope of the invention should be defined by the appended claims and not by the specific embodiment.

What is claimed is:

1. A container for a product, comprising:

a bottom portion;

side walls connected to edges of the bottom portion;

at least one first supporting portion protruding from the bottom portion of the container, the at least one first supporting portion including at least one convex surface to support the product, at least one concave surface substantially parallel to the at least one convex surface, and at least one side surface, both the at least one convex surface and the at least one concave surface being supported by the at least one side surface such that the at least one convex surface and the at least one concave surface are located at elevated spatial positions from the bottom portion, with the position of the at least one concave surface located between the at least one convex surface and the bottom portion, whereby when the product is received within the container, the product is supported by the at least one convex surface, and the product is spaced apart from the at least one concave surface, thus, during the application of an external load, the at least one convex surface takes a portion of the load and will deform before and independently from the at least one concave surface, and, if the external force is great enough, the at least one concave surface then takes the remaining portion of the external load and supports the product.

2. The container as claimed in claim 1, wherein the total area of the at least one convex surface is less than a half of the area of the at least one first supporting portion connecting the bottom portion of the container.

3. The container as claimed in claim 1, wherein the at least one first supporting portion includes two convex surfaces and a concave surface, in which the convex surfaces are separated by the concave surface.

4. The container as claimed in claim 1, wherein the bottom portion, the side walls, and the at least one first supporting portion are integrally formed.

5. The container as claimed in claim 1, which is made of pulp.

6. A combination of a container and a CD-ROM PLAYER, wherein the container comprises:

a bottom portion;

side walls connected to edges of the bottom portion;

at least one first supporting portion protruding from the bottom portion of the container, the at least one first supporting portion including at least one convex surface to support the CD-ROM PLAYER, at least one concave surface substantially parallel to the at least one convex surface, and at least one side surface, both the at least one convex surface and the at least one concave surface being supported by the at least one side surface such that the at least one convex surface and the at least one concave surface are located at elevated spatial positions from the bottom portion, with the position of the at least one concave surface located between the at least one convex surface and the bottom portion, whereby when the CD-ROM PLAYER is received within the container, the at least one convex surface can support the CD-ROM PLAYER, and the CD-ROM PLAYER is spaced apart from the at least one concave surface.

* * * * *